US008297458B2

(12) United States Patent
Sumimiya et al.

(10) Patent No.: US 8,297,458 B2
(45) Date of Patent: Oct. 30, 2012

(54) CAP AND CONTAINER FOR IMPROVED SEALING

(75) Inventors: Katsuaki Sumimiya, Hyogo (JP); Hiroshi Hamana, Hyogo (JP)

(73) Assignee: Nihon Yamamura Glass Co., Ltd., Hyogo (JP)

( * ) Notice: Subject to any disclaimer, the term of this patent is extended or adjusted under 35 U.S.C. 154(b) by 212 days.

(21) Appl. No.: 12/808,698

(22) PCT Filed: Jan. 31, 2008

(86) PCT No.: PCT/JP2008/051514

§ 371 (c)(1),
(2), (4) Date: Jun. 17, 2010

(87) PCT Pub. No.: WO2009/096019

PCT Pub. Date: Aug. 6, 2009

(65) Prior Publication Data

US 2010/0264110 A1 Oct. 21, 2010

(51) Int. Cl.

| | |
|---|---|
| ***B65D 41/04*** | (2006.01) |
| ***B65D 53/00*** | (2006.01) |
| ***B65D 41/34*** | (2006.01) |

(52) U.S. Cl. ..... 215/329; 215/252; 215/258; 215/341; 215/352

(58) Field of Classification Search ..... 215/252, 215/258, 352, 341, 349, 351

See application file for complete search history.

(56) References Cited

U.S. PATENT DOCUMENTS

| | | | | |
|---|---|---|---|---|
| 4,658,976 | A * | 4/1987 | Pohlenz | 215/252 |
| 6,221,451 | B1 * | 4/2001 | Lauer et al. | 428/36.5 |
| 6,779,672 | B2 * | 8/2004 | Kano et al. | 215/344 |
| 2003/0203143 | A1 | 10/2003 | Nagashima | |

FOREIGN PATENT DOCUMENTS

| | | |
|---|---|---|
| EP | 1 892 267 | 2/2008 |
| JP | 8-53116 | 2/1996 |
| JP | 11-222249 | 8/1999 |
| JP | 3936487 | 10/2000 |
| JP | 2002-293343 | 10/2002 |
| JP | 2006-151407 | 6/2006 |
| JP | 2006-160290 | 6/2006 |
| WO | 2006/134652 | 12/2006 |

OTHER PUBLICATIONS

International Search Report issued May 1, 2008 in International (PCT) Application No. PCT/JP2008/051514.

* cited by examiner

*Primary Examiner* — Robin Hylton
(74) *Attorney, Agent, or Firm* — Wenderoth, Lind & Ponack, L.L.P.

(57) ABSTRACT

A cap includes a cap main body and a gasket, and the gasket includes an inner leg, a bent part, and a flange part. A portion of the gasket connected to an inner circumferential side of the inner leg is positioned lower than a portion of the gasket connected to an outer circumferential side of the inner leg. The top plate of the gasket includes a flange part disposed between the inner leg and the bent part, and the flange part is thinner than a portion of the top plate that is contiguous with the inner circumferential side of the inner leg.

13 Claims, 7 Drawing Sheets

CAP AND CONTAINER FOR IMPROVED SEALING

TECHNICAL FIELD

The present invention relates to a cap having a two-piece structure including a cap main body and a gasket, attached to a mouth part of a container accommodating, for example, various drinks (regardless of carbonated or uncarbonated, and regardless of containing alcohol or not), and a container having the cap.

BACKGROUND ART

As a conventional cap having a two-piece structure, for example, a cap disclosed in Patent Document 1 shown in FIG. 7 is known. Specifically, the cap includes a cap main body 4 and a gasket 5. The cap main body 4 has a top wall 6 and a skirt wall 7 pending from the outer circumference of the top wall 6, and the cap main body 4 in which the skirt wall 7 is formed with an internal thread 9 that comes in screw engagement with an external thread 10 of a container mouth part 3, the gasket 5 made of synthetic resin for hermetically sealing the container mouth part 3, and a tamper evidence band 13 connected below the skirt wall 7 via breakable bridges 12 are provided.

The gasket 5 includes a top plate 17 that comes into abutment with a distal end part 3*a* of the container mouth part 3 to cover the distal end part 3*a*, and an annular inner leg 18 pending from the top plate 17 and coming into close contact with an inner circumferential face 3*b* of the container mouth part 3. Further, on the outer circumferential edge of the top plate 17, an annular bent part 19 bending downward with respect to the top plate and having an outer circumferential face inclined to extend outwardly is continuously provided.

In the above cap, even when a container is stored at a low temperature (for example, 4 to 5° C.), it is possible to prevent leakage of airtightness inside the container caused by a doming phenomenon. This is because when a doming phenomenon occurs, an upper end part of the circumferential wall of the cap main body 4 contracts toward the center, and a pushing force toward the center direction of the container mouth part 3 is exerted on outer circumferential edge of the gasket 5, so that the bent part of the gasket 5 is pushed against an outer circumferential face 3*c* of the container mouth part 3 by this pushing force.

Patent Document 1: Japanese Patent Publication No. 3936487

DISCLOSURE OF THE INVENTION

Problems to be Solved by the Invention

However, in the above conventional cap, for example, when the wall thickness of the top wall 6 of the cap main body 4 is large and a doming phenomenon does not occur, the bent part 19 is not pushed against the outer circumferential face 3*c* of the container mouth part 3, and the aforementioned leakage of airtightness may occur due to internal pressure of the container 2.

The present invention has been devised in light of the aforementioned circumstances, and an object of the present invention is to provide a cap capable of improving sealing performance of a container, and suited for use in the case where the internal pressure of the container is high, for example, when the contents of the container is carbonated beverage, and a container having the cap.

Means for Solving the Problems

In order to achieve the above object, a cap according to the present invention includes a cap main body having a top wall and a skirt wall pending from an outer circumferential part of the top wall, the skirt wall being provided with an internal thread that comes in screw engagement with an external thread of a container mouth part, and a gasket made of synthetic resin for hermetically sealing the container mouth part, wherein the gasket has a top plate that comes in abutment with a distal end part of the container mouth part to cover the distal end part, and an annular inner leg pending from the top plate, adapted to close fit with an inner circumferential face of the container mouth part, and an outer circumferential edge of the top plate is continuously formed with an annular bent part that bends downward with respect to the top plate and has the inner circumferential face covering an outer circumferential face of the container mouth part, and the cap main body has a biasing part that biases an outer circumferential face of the bent part of the gasket in a closed state, so that the biased bent part elastically deforms to be pushed against the outer circumferential face of the container mouth part.

In the above cap, the outer circumferential face of the bent part of the gasket is inclined downwardly to extend outwardly, and the biasing part of the cap main body may be configured to bias the bent part downwardly in the closed state.

Here, a lower end of the bent part may be situated between an undulation starting point of a swelling part formed in an outer circumferential face of the inner leg and a maximum diameter part of the swelling part.

In addition, the biasing part may be a projecting part that projects inside the cap main body provided from a bottom face of the top wall to an inner face of the skirt wall.

Further, a top face of the top plate of the gasket may be flush except for a recess part provided in a center thereof.

The cap main body may be made of synthetic resin, a tamper evidence band may be connected to a lower part of the skirt wall via breakable bridges, a latch piece extending inwardly and upwardly from a lower part of the tamper evidence band may be formed continuously to the tamper evidence band, below the external thread in the container mouth part, a stopper that is overcome by the elastically deformed latch piece upon attachment to the container mouth part, and latched by the elastically recovered latch piece after attachment may be provided, the outer circumferential face of the inner leg may be formed with a swelling part, and a position in the inner circumferential face of the container mouth part where the swelling part comes into abutment most strongly in the closed state may be located 2.0 to 2.5 mm lower than a distal end of the container mouth part.

The gasket may contain sodium sulfite.

A thickness of the top wall of the cap main body may be 1.0 mm or more.

On the other hand, a container of the present invention is a container to which the cap according to any one of claims 1 to 8 is attached to a mouth part thereof.

Moreover, the container may accommodate carbonated beverage.

Further, the container may be entirely provided with a gas barrier layer.

Effects of the Invention

By the present invention, it is possible to improve sealing performance of a container, and to obtain a cap suited for use in the case where the internal pressure of the container is high, for example, when the contents of the container are carbonated beverage, and a container having such a cap.

That is, in the present invention, the bent part that is biased by the biasing part of the cap main body elastically deforms to be pushed against the outer circumferential face of the container mouth part, so that engagement of the bent part with respect to the container mouth part can be greatly strengthened, and sealing performance can be improved.

The present invention also makes it easy to optimize a fitting degree of the gasket with respect to the container mouth part. This is because if the bent part is too short for a lower end of the bent part to reach a proximal end of a swelling part, sealing performance of the container in a closed state is insufficient even though attachment or detachment of the gasket to and from the container mouth part can be executed smoothly, whereas if the bent part is so long that the lower end of the bent part exceeds the maximum diameter part of the swelling part, attachment or detachment of the gasket to and from the container mouth part may not be executed smoothly even though the sealing performance of the container in a closed state is sufficient.

In the invention, the structure of the biasing part is simple, and only a slight change on structure of a conventional cap main body suffices, so that the cap of the present invention can be readily obtained at low cost.

Moreover, the following effect is obtained. That is, in a conventional cap shown in FIG. 7, since an annular recess part 50 and a thin-thickness part 51 are provided in the top plate 17 of the gasket 5, impacts at the time of breakage of the bridges 12 of the band 13 in opening the container are difficult to propagate to the gasket 5, and detachment of the gasket 5 from the container mouth part 3 is not promoted by the impacts, so that the gasket 5 remains in the container mouth part 3. Therefore, when the gasket 5 is blown off by the internal pressure of the container 2 after the top wall 6 of the cap main body 4 disengages from the gasket 5 by an opening operation, the blown off gasket 5 comes into collision with the cap main body 4 and generates an abnormal noise. This can make the person opening the bottle feel unpleasant or anxious.

However, by making the top face of the top plate flush, it is possible to promote the disengagement of the gasket from the container mouth part by the aforementioned impacts, and to prevent an abnormal noise from occurring at the time of opening.

In the present invention, a leak angle (turning amount of the cap main body from start of opening the cap in an unopened state to leakage) is 170° to 250°, so that high tamper evidence performance is obtained because a bridge break angle (turning amount of the cap main body from start of opening the cap in an unopened state to breakage of the bridge) is usually one hundred and several tens of degrees.

Also, oxygen remaining in the container after hermetical sealing can be rapidly absorbed by the oxygen absorbing effect of sodium sulfite, and the preservation state of the contents in the container can be kept well for a long time.

Additionally, by thickening the top wall of the cap main body, it is possible to prevent doming phenomenon.

Also, the present invention provides a container with very little gas loss is obtained.

DESCRIPTION OF REFERENCE NUMERALS

Figure 1:
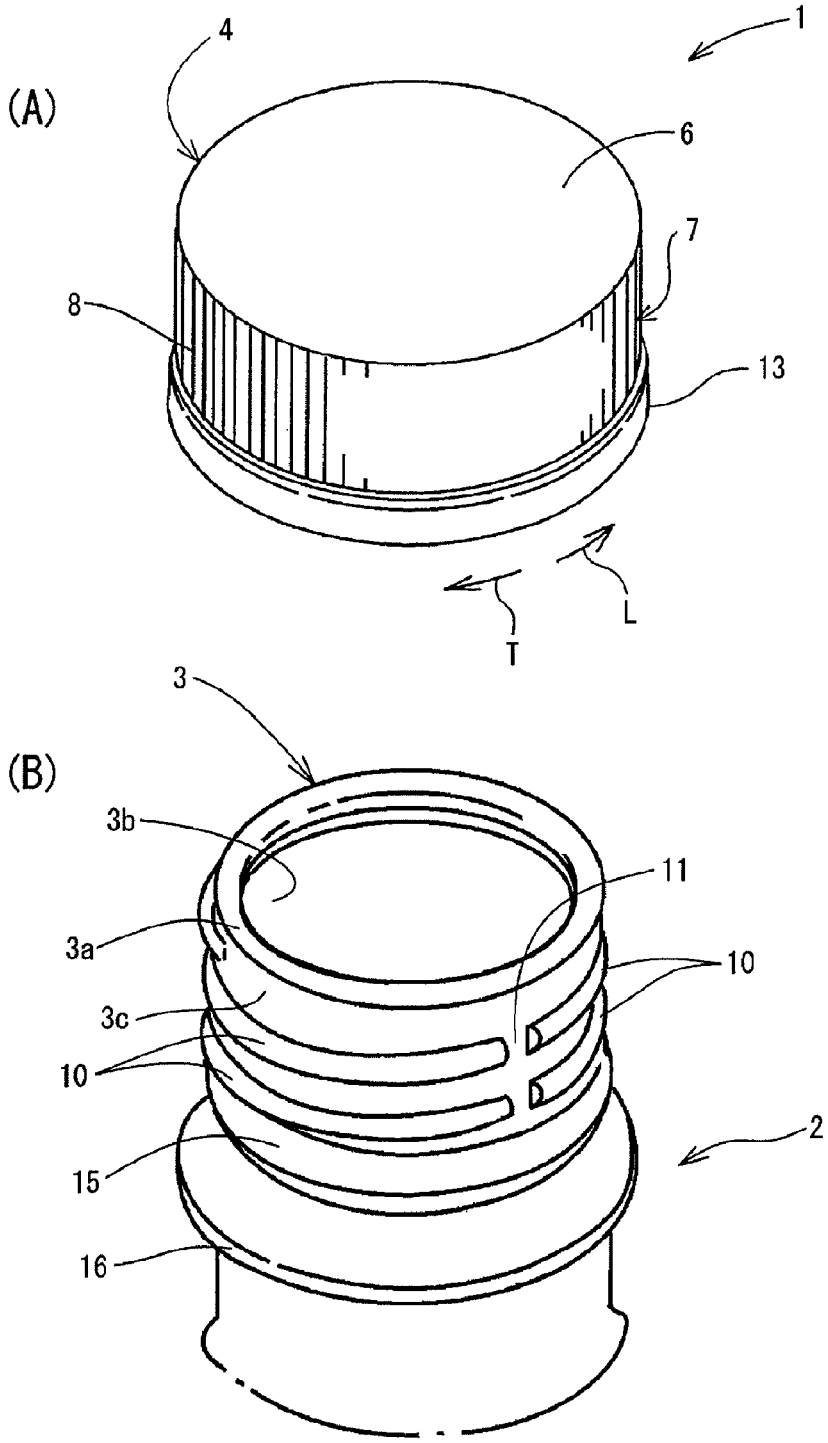
FIGS. 1(A) and 1(B) are perspective views schematically showing configurations of a cap according to a first embodiment of the present invention, and a principal part of a container having the cap.

1 Cap
2 Container
3 Container mouth part
4 Cap main body
5 Gasket
6 Top wall
7 Skirt wall
9 Internal thread
10 External thread
12 Bridge
13 Tamper evidence band
14 Latch piece
17 Top plate
18 Inner leg
19 Bent part
21 Biasing part

BEST MODE FOR CARRYING OUT THE INVENTION

In the following, embodiments of the present invention will be described with reference to the drawings. Here, FIGS. 1(A) and 1(B) are perspective views schematically showing configurations of a cap 1 according to one embodiment of the present invention, and a principal part of a container 2 having the cap, FIG. 2 is a half longitudinal section view (view showing a left half of the longitudinal section that is substantially left-right symmetry) schematically showing the configuration of the cap 1, and FIG. 3 is a half longitudinal section view (view showing a left half of the longitudinal section that is left-right symmetry) schematically showing a configuration of a gasket 5 of the cap 1.

As shown in FIGS. 1(A) and 1(B), the cap 1 according to the present embodiment is adapted to be attached to a mouth part 3 of a container (for example, PET bottle) 2 that is produced separately from the cap 1, and is molded by injection molding or compression molding. The cap 1 is a pilfer proof cap having a function of proving that the container has not been opened (never opened).

On the other hand, the contents accommodated in the container 2 are beer. However, the contents are not limited to beer, but other alcoholic beverages (for example, wine, sparkling wine), carbonated beverages, other soft drinks and the like may be accommodated.

Figure 2:
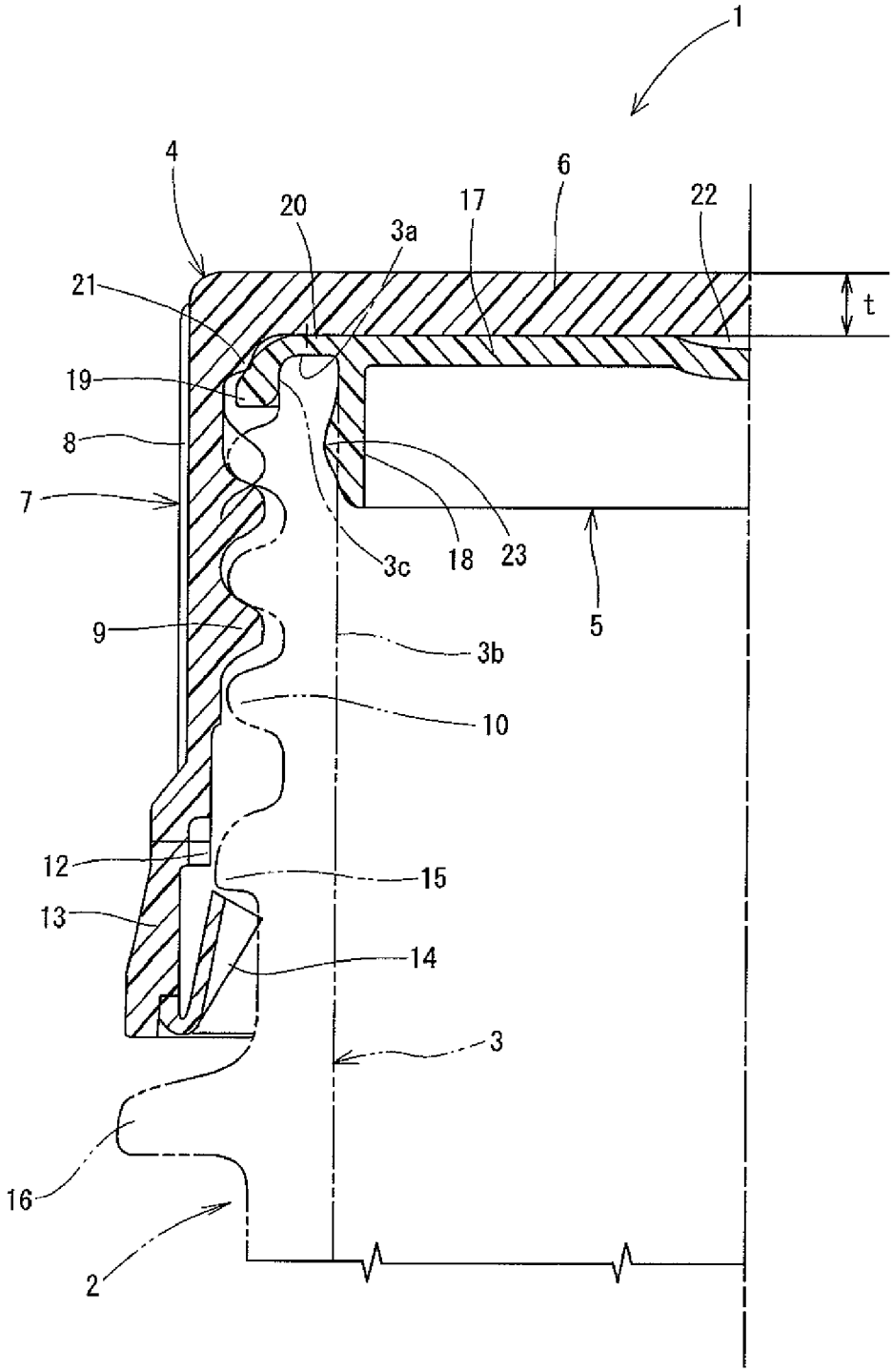
FIG. 2 is a half longitudinal section view schematically showing the configuration of the cap.
Figure 3:
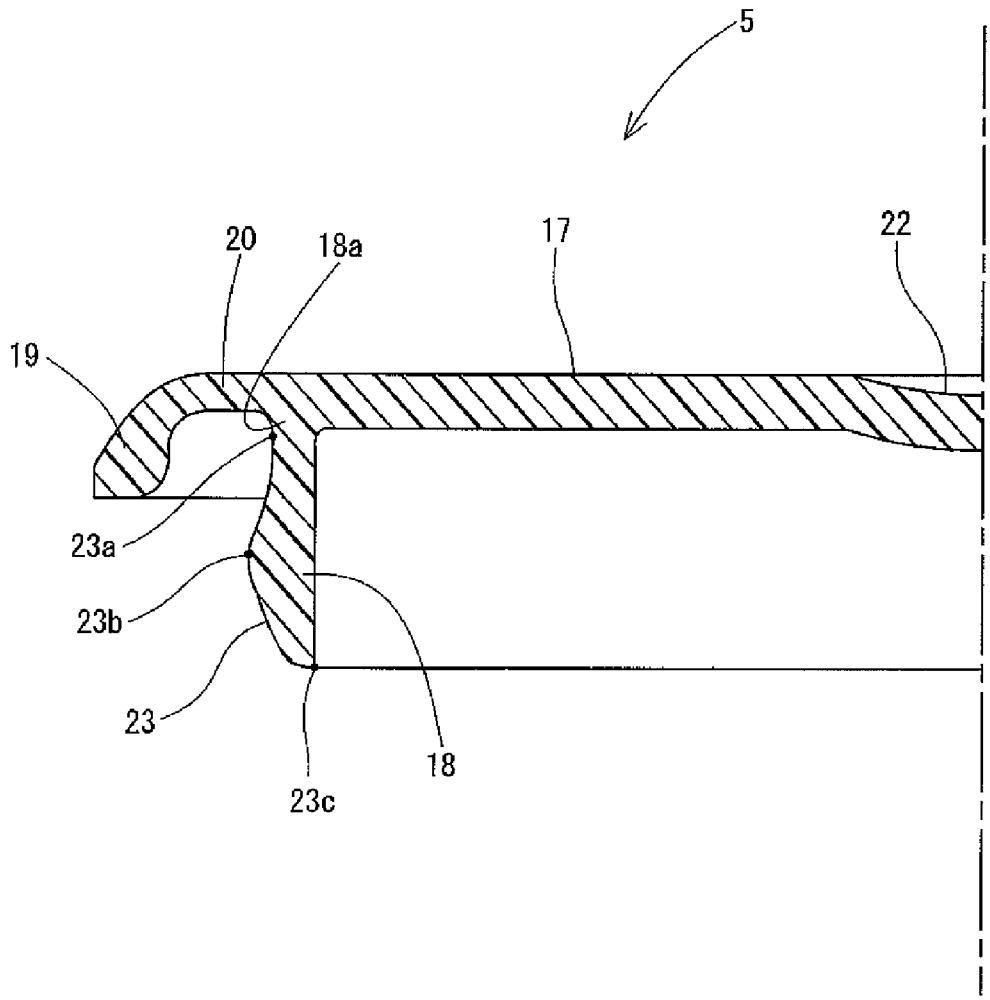
FIG. 3 is a half longitudinal section view schematically showing a configuration of a gasket of the cap.

As shown in FIG. 2, the cap 1 has a cap main body 4 and a gasket 5 made of synthetic resin for hermetically sealing the container mouth part 3. Here, as a material of the cap main body 4 and the gasket 5, a synthetic resin having excellent flexibility and small friction resistance, for example, a base resin of e.g., polypropylene (homo-, block-, random- and the like) or polyethylene (HD (high density), LL (linear low density), LD (low density) and the like) is employed.

As shown in FIG. 1(A) and FIG. 2, the cap main body 4 has a top wall 6 that is circular in plane view, and a skirt wall 7 pending from outer circumference of the top wall 6. Here, the outer circumferential face of the skirt wall 7 is provided with knurled grooves 8, and an inner circumferential face is provided with an internal thread 9 (see FIG. 2), and the internal thread 9 is adapted to screw engage with an external thread 10 of the container mouth part 3. Here, in respective appropriate positions of the internal thread 9 and the external thread 10 (positions where screw engaging or disengaging operation of threads 9, is not be interfered), a longitudinally extending groove 11 is provided.

Below the skirt wall 7, as shown in FIG. 1(A) and FIG. 2, a tamper evidence band (hereinafter, simply referred to as "band") 13 is continuously provided via a plurality of breakable bridges 12 provided at a constant interval in the circumferential direction (see FIG. 2), and inside the band 13, as shown in FIG. 2, a plurality of latch pieces 14 extending inwardly and upwardly from the bottom of the band 13 are provided.

On the other hand, as shown in FIG. 1(B), the container mouth part 3 is provided with a stopper 15 that is overcome by the band 13 at the time of attaching the cap 1 to the container mouth part 3 and then prevents the band 13 from falling out by latching of the latch pieces 14 of the band 13, and a flange 16 situated below the stopper 15, for holding, together with the stopper 15, the band 13 having overcome the stopper 15.

Meanwhile, as shown in FIGS. 2 and 3, the gasket 5 is concentrically provided with a substantially disc-like top plate 17 abutting with a distal end part 3*a* of the container mouth part 3 to cover the same, and an annular (substantially cylindrical) inner leg 18 pending from the top plate 17 and closely fitting with the inner circumferential face of the container mouth part 3. As shown in FIG. 2, the outer circumferential edge of the top plate 17 is provided continuously with an annular bent part 19 bending downwardly with respect to the top plate 17, and having an inner circumferential face covering the outer circumferential face of the container mouth part 3.

As shown in FIG. 2, the gasket 5 is fitted inside an upper part of the cap main body 4. That is, an outer diameter of the gasket 5 is larger than an inner diameter of a crest part of the internal thread 9 of the cap main body 4 and smaller than an inner diameter of a valley part, such that the circumferential part of the gasket 5 engages an upper part of the internal thread 9 of the cap main body 4.

And in the present embodiment, for attaching the cap 1 to the container mouth part 3, a turning force in a direction of an arrow T in FIG. 1(A) is applied to the cap main body 4 in a state that the internal thread 9 of the cap main body 4 (see FIG. 2) is in screw engagement with the external thread 10 of the container mouth part 3 (see FIG. 1(B) and FIG. 2). At this time, the cap main body 4 screws downward in FIG. 1(A), and then each latch piece 14 of the band 13 (see FIG. 2) comes into abutment with the stopper 15 below the external thread 10 of the container mouth part 3 (see FIG. 1(B) and FIG. 2). The latch piece is guided by the stopper 15 so as to be elastically deformed in a diameter expand direction to overcome the stopper 15, and then elastically recover their initial state. In this manner, attachment of the cap 1 is completed.

In this attached state (unopened state), the inner leg 18 of the gasket 5 closely fits with the inner circumferential face 3*b* of the container mouth part 3 (see FIG. 2), a flange part 20 situated between the inner leg 18 and the bent part 19 of the gasket 5 (see FIG. 2 and FIG. 3) closely fits with the distal end part (distal end face) 3*a* of the container mouth part 3, and the bent part 19 of the gasket 5 closely fits with an outer circumferential face 3*c* of the container mouth part 3 (see FIG. 1(B) and FIG. 2). In FIG. 2, the cap 1 that is not attached to the container mouth part 3 is represented by a solid line, and a part of the container 2 to which the cap 1 is to be attached is represented by a virtual line (two-dot chain line). Here, in the cap 1 that is attached to the container mouth part 3, the inner leg 18 biased inwardly by the inner circumferential face of the container mouth part 3 elastically deforms and thus has a reduced diameter (not shown). As shown in FIG. 2, the flange part 20 is thinner than a portion of the top plate 17 that is contiguous with the inner circumferential side of the inner leg 18, and the portion of the gasket 5 contiguous with the inner circumferential side of the inner leg 18 is positioned lower than the flange part 20.

The container can be opened by applying a turning force in a direction of an arrow L in FIG. 1(A) on the cap main body 4 of the cap 1 that is attached to the container mouth part 3, and at this time, the band 13 having the latch pieces 14 to be latched with the stopper 15 of the container mouth part 3 remains, and only a region other than the band 13 (including the gasket 5) in the cap 1 screws out of the container mouth part 3 by the turning force in the direction of the arrow L. Therefore, all of the bridges connecting the band 13 and the skirt wall 7 break at the time of the first opening.

Next, characteristic configurations of the present embodiment will be described.

First, the cap main body 4 has a biasing part 21 that biases the outer circumferential face of the bent part 19 of the gasket 5 in a closed state (state where screw engagement of the internal thread 9 with respect to the external thread 10 is completed) such that the bent part 19 that is biased elastically deforms to be pushed against the outer circumferential face 3*c* of the container mouth part 3. Therefore, engagement of the bent part 19 with respect to the container mouth part 3 can be further secured, and the sealing performance can be further improved.

Here, as shown in FIG. 2, the biasing part 21 is a projecting part that projects inside the cap main body 4, extending from the bottom face of the top wall 6 of the cap main body 4 to the inner face of the skirt wall 7. In this embodiment, since the outer circumferential face of the bent part 19 of the gasket 5 is inclined to extend outwardly in the downward direction, the biasing part 21 of the cap main body 4 biases the bent part 19 downwardly in a closed state, and this biasing force is converted into a force that pushes the bent part 19 against the outer circumferential face 3*c* of the container mouth part 3 as described above.

The bent part 19 may not or may be in abutment with the outer circumferential face 3*c* of the container mouth part 3 in the state of not being biased against the biasing part 21 (opened state). In the former case, since the gasket 5 can be fitted in or removed from the container mouth part 3 smoothly, excellent opening/closing of the cap 1 can be realized while excellent sealing performance in a closed state is maintained. In the latter case, since the gasket 5 is strongly fit into the container mouth part 3, very excellent sealing performance is obtained by the cap 1.

Figure 7:
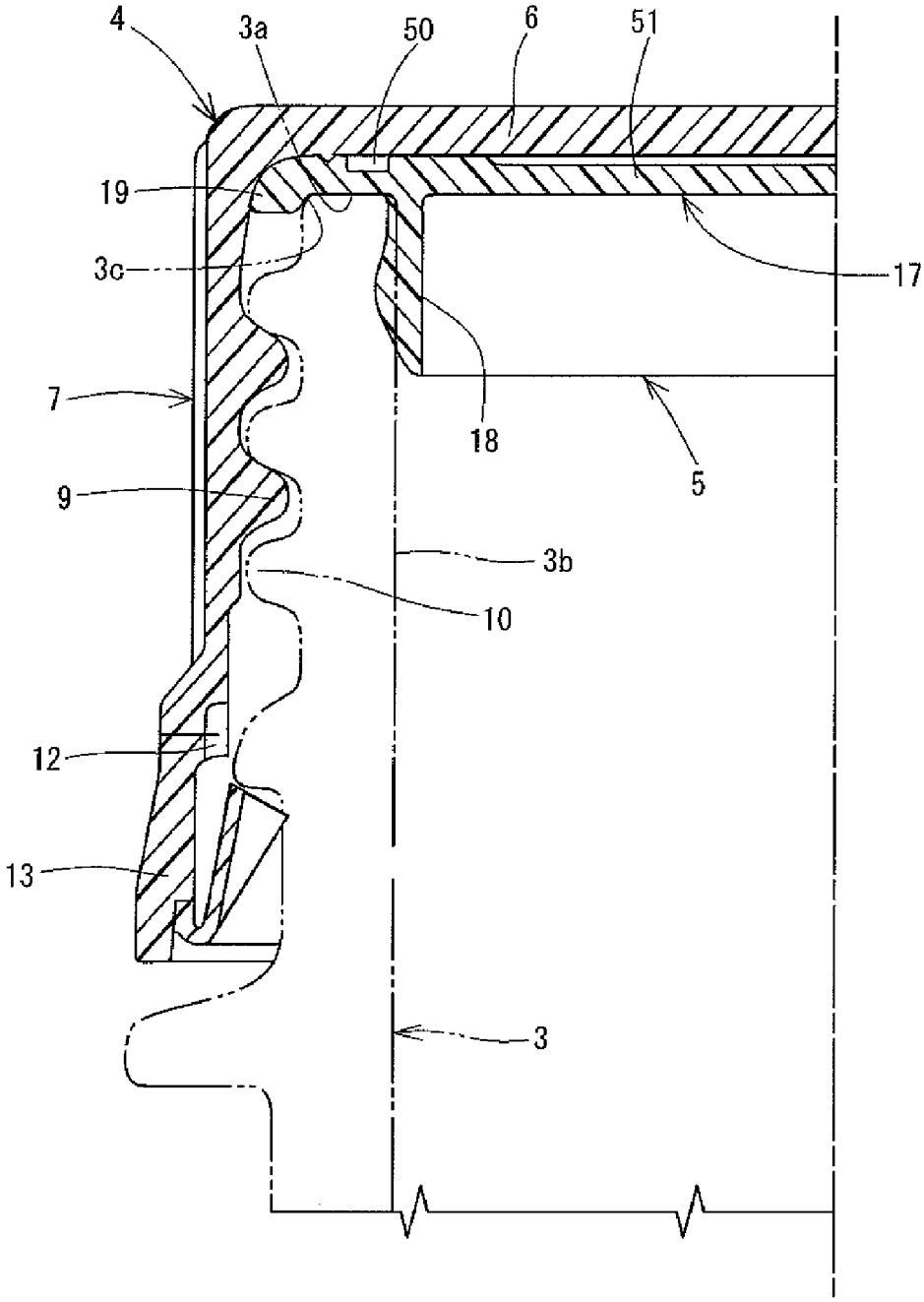
FIG. 7 is a half longitudinal section view schematically showing a configuration of a conventional cap.

The top face of the top plate 17 of the gasket 5 is flush except for a recess part (air pool part) 22 provided in its center, to uniformize the thickness of the top plate 17 as much as possible. Therefore, in the conventional cap shown in FIG. 7, since an annular recess part 50 and a thin-thickness part 51 are provided in the top plate 17 of the gasket 5, an impact at the time of breakage of the bridges 12 of the band 13 in opening the container are difficult to propagate to the gasket 5, and detachment of the gasket 5 from the container mouth part 3 is not promoted by the impact, and the gasket 5 remains in the container mouth part 3. When the gasket 5 is blown off by the internal pressure of the container 2 after the top wall 6 of the cap main body 4 disengages from the gasket 5 by an opening operation, the blown off gasket 5 comes into collision with the cap main body 4 and generates an abnormal noise. This can make a person opening the bottle feel unpleasant or anxious. However, in the present embodiment, since the thickness of the top plate 17 is uniformized by making the top face of the top plate 17 flush, it is possible to promote the disengagement of the gasket 5 from the container mouth part 3 by the aforementioned impact, and to prevent an abnormal noise from occurring at the time of opening.

Further, the outer circumferential face of the inner leg 18 is provided with a swelling part 23, and a position in the inner circumferential face of the container mouth part 3 where the swelling part 23 comes into abutment most strongly in a closed state (seal point) is adapted to be located 2.0 to 2.5 mm lower than the distal end of the container mouth part 3. That is, as shown in FIG. 3, in the outer circumferential face of the inner leg 18, the swelling part 23 is provided on a lower (distal end) side of a proximal end part 18*a* extending in a vertical direction. Here, the swelling part 23 has an outer diameter increasing from a proximal end (undulation starting point) 23*a* to a maximum diameter part (a part where the outer diameter is maximum) 23*b* on the lower side (distal end side), and decreasing from the maximum diameter part 23*b* toward a distal end (undulation ending point) 23*c* on the lower side (distal end side). By setting the seal point as described above, a leak angle (turning amount (opening angle) of the cap main body 4 from start of opening of the cap 1 in an unopened state to leakage) is 170° to 250°, so that high tamper evidence performance is obtained because a bridge break angle (turning amount of the cap main body 4 from start of opening of the cap 1 in an unopened state to breakage of the bridge 12) is usually one hundred and several tens of degrees. This is because, in principle, the tamper evidence performance is guaranteed when the leakage at the time of bottle opening occurs simultaneously or subsequent to breakage of bridges, and in particular, if the bridge 12 is broken before occurrence of leakage, it can be evaluated that the tamper evidence performance is excellent. In other words, since tamper evidence performance is evaluated to be excellent when an LB angle (leak angle-bridge break angle) is 0° or larger, the position of the seal point may be set so that such an LB angle is obtained.

On the other hand, the bent part 19 is configured so that its lower end is positioned between the proximal end 23*a* of the swelling part 23 formed in the outer circumferential face of the inner leg 18 and the maximum diameter part 23*b* situated below the proximal end 23*a* (see FIG. 2, FIG. 3). With this configuration, it becomes easy to optimize the fitting degree of the gasket 5 with respect to the container mouth part 3. This is because if the bent part 19 is too short for the lower end of the bent part 19 to reach the proximal end 23*a* of the swelling part 23, sealing performance of the container in a closed state is insufficient even though attachment or detachment of the gasket 5 to and from the container mouth part 3 can be executed smoothly, whereas if the bent part 19 is so long that a lower end of the bent part 19 exceeds the maximum diameter part 23*b* of the swelling part 23, attachment or detachment of the gasket 5 to and from the container mouth part 3 may not be executed smoothly even though the sealing performance of the container in a closed state is sufficient.

A thickness t of the top wall 6 of the cap main body 4 (see FIG. 2) is preferably 1.0 mm or more, and in the present embodiment, the thickness t of the top wall 6 is 1.6 mm. In other words, by making the thickness t of the top wall 6 large, it is possible to securely prevent a doming phenomenon from occurring in the top wall 6 due to the internal pressure of the container 2.

Further, the gasket 5 contains 1 to 10% by weight of sodium sulfite as an oxygen absorber. As a result, oxygen remaining in the container 2 after hermetical sealing can be rapidly absorbed and a preservation state of the contents in the container 2 can be kept well for a long time.

On the other hand, the container 2 is entirely provided with a gas barrier layer (not shown). More specifically, for example, by forming (coating) a layer of DLC (diamond like carbon) inside or outside the container 2, or by employing a multi-layer structure in which PET (polyethylene terephthalate) and nylon are laminated, a gas barrier layer can be achieved. In the former case, the DLC layer functions as a gas barrier layer, and in the latter case, the nylon layer functions as a gas barrier layer. With such a configuration, gas barrier property of the container 2 is very excellent, and for example, a gas loss after storage at normal temperature is 1% or less per month for a standard of 3 GV (gas volume).

Next, performances of the present cap 1 and the container 2 will be described.

Figure 4:
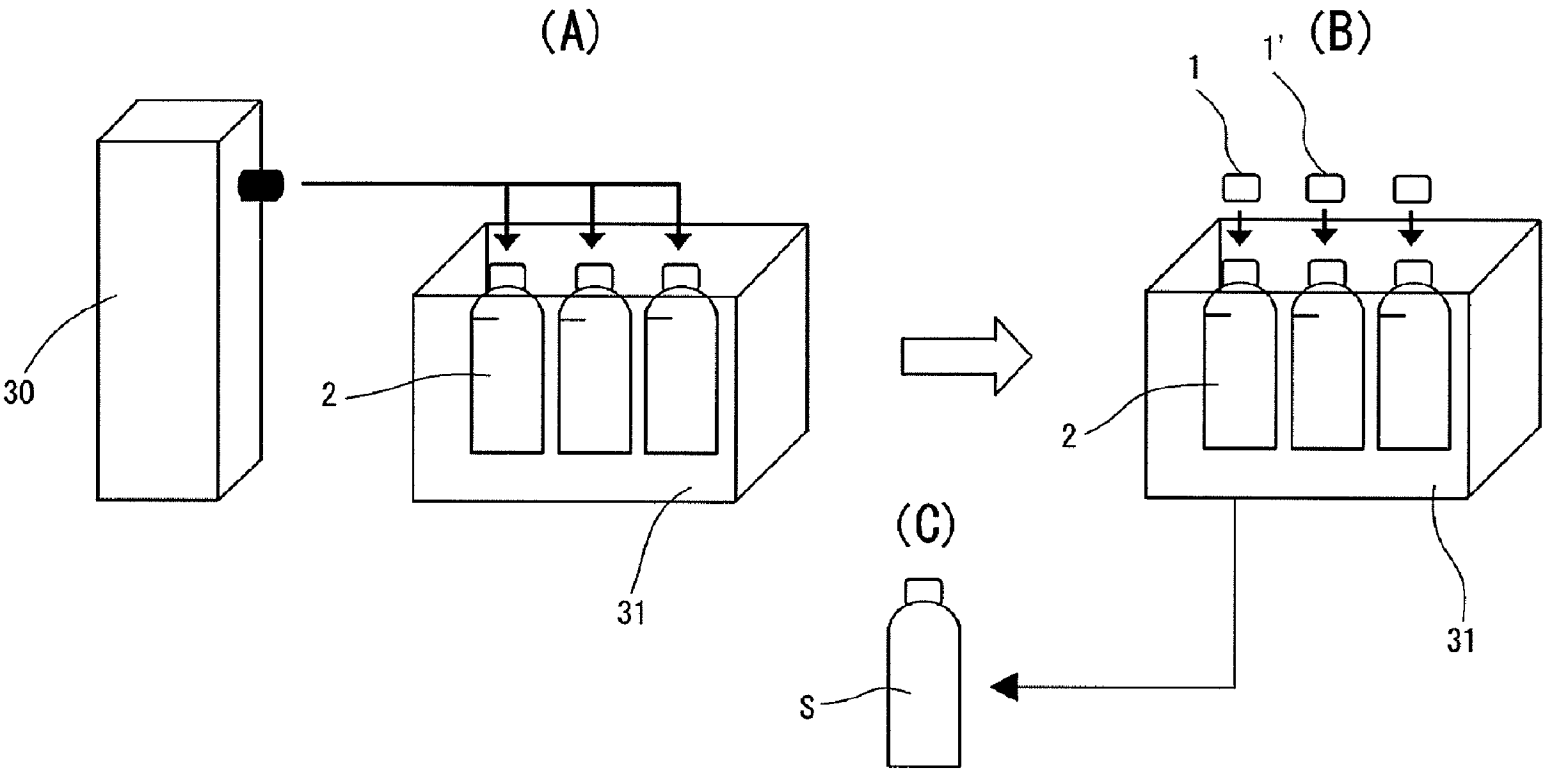
FIGS. 4(A) to 4(C) are explanatory views schematically showing a method of measuring dissolved oxygen.
Figure 5:
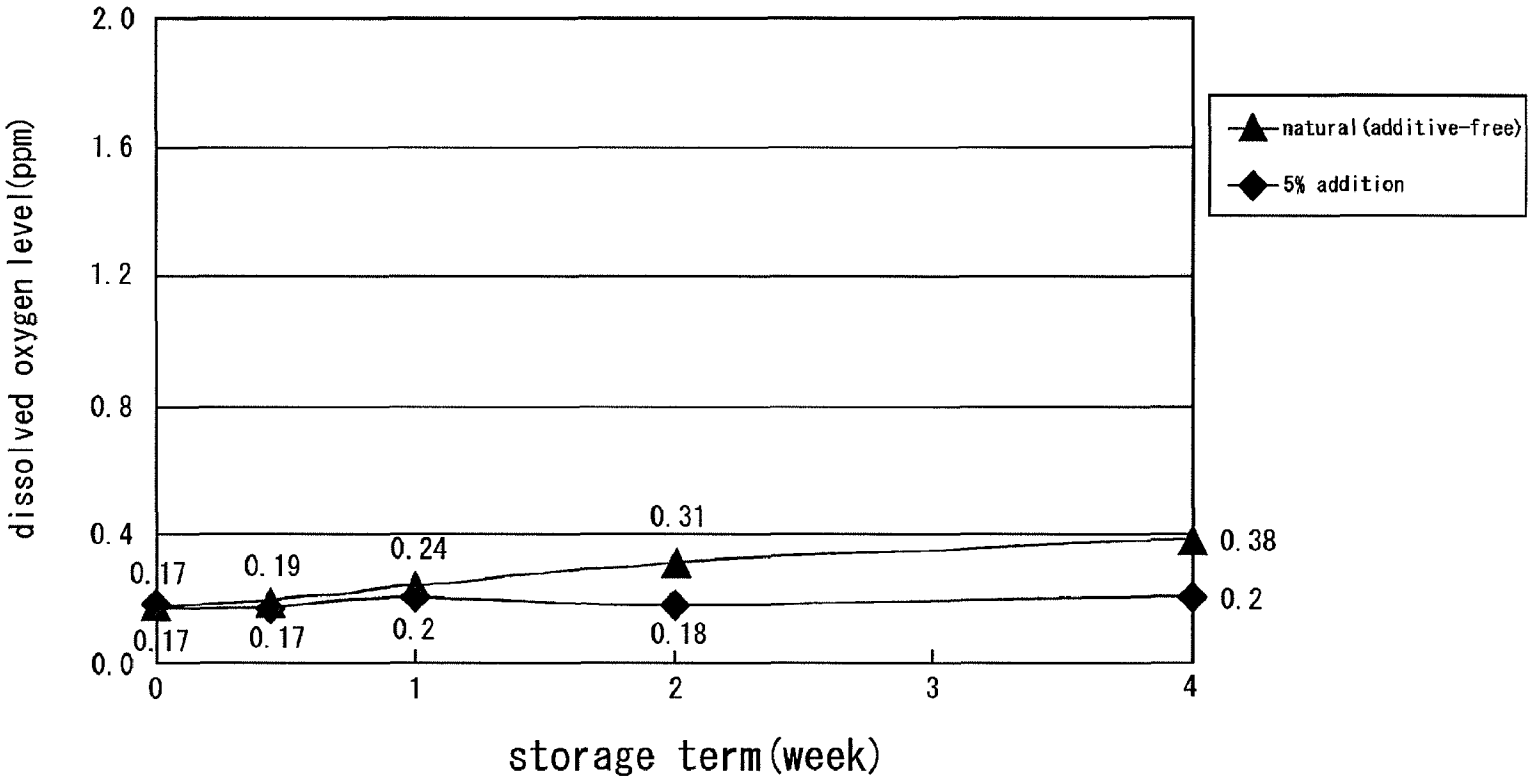
FIG. 5 is a graph schematically showing a result of the measurement of dissolved oxygen.

First, for examining oxygen absorbing performance by the gasket 5 added with sodium sulfite as an oxygen absorber, dissolved oxygen was measured. Specifically, as shown in FIG. 4(A), this measurement was conducted in such a manner that an external container 31 was filled with low dissolved oxygen water generated by a low dissolved oxygen water generator 30, the container 2 was accommodated in the external container 31, the container 2 was charged with the low dissolved oxygen water, and immediately after this charging, a cap was attached (capping) as shown in FIG. 4(B), and a sample S thus obtained was stored at a predetermined temperature (22° C.) as shown in FIG. 4(C), and a dissolved oxygen amount in the water as contents in each sample S was measured for four weeks. As the cap to be attached to the container 2, the present cap 1 obtained by adding 5% sodium sulfite as an oxygen absorber to the gasket 5, and a conventional cap 1' that is different from the present cap 1 only in that the oxygen absorber is not added were used. Results of the above measurement are shown in FIG. 5. In the graph of FIG. 5, a vertical axis represents dissolved oxygen level (ppm), and a horizontal axis represents storage term (week), and a result of sample S to which the present cap 1 is attached is represented by "5% addition", and a result of sample S to which the conventional cap 1' is attached is represented by "natural".

As is apparent from FIG. 5, when the conventional cap 1' was attached, the dissolved oxygen amount on the 4th week was 0.38 ppm, and when the present cap 1 was attached, the dissolved oxygen amount on the 4th week was 0.2 ppm. This difference demonstrates an oxygen absorbing effect of the sodium sulfite contained in the gasket 5.

Figure 6:
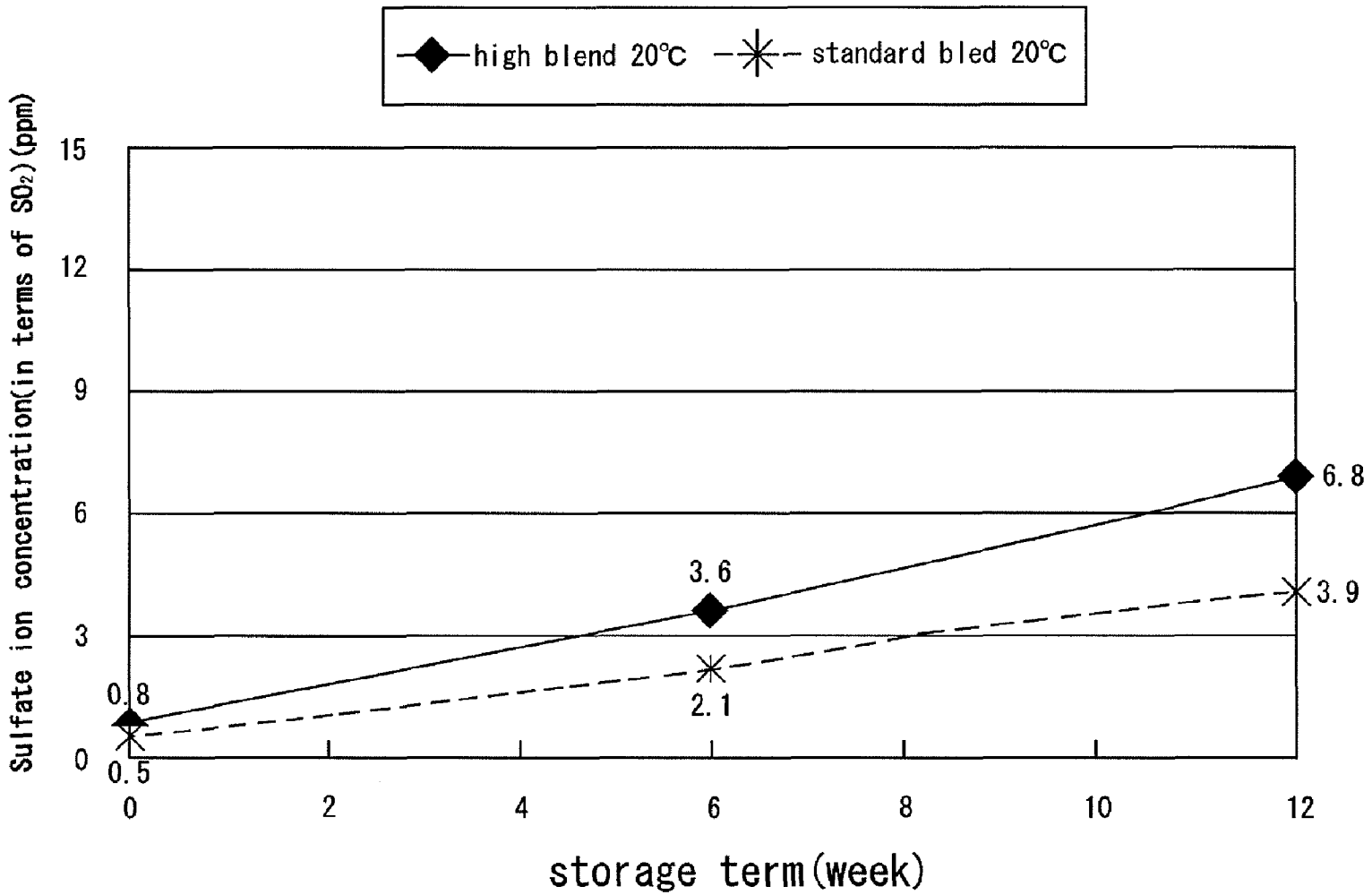
FIG. 6 is a graph schematically showing a result of measuring a sulfate ion concentration.

Sequentially, for examining the effect of sodium sulfite diluted into the contents from the present cap 1 having the gasket 5 containing sodium sulfite, the following measurement was conducted. More specifically, in a 280 mL PET bottle as the container 2 charged with the contents (acid beverage in the present measurement, although examples of the contents include acidic beverages, dairy products, fermentation dairy products and the like), a high-blended sample to which the cap 1 having the gasket 5 containing 7% sodium sulfite is attached, a standard blended sample to which the cap 1 having the gasket 5 containing 5% sodium sulfite is attached were prepared, and these samples were stored at 20° C., and sulfate ion concentration in the acidic beverage of each sample (in terms of $SO_2$) was measured for 12 weeks. The result is shown in FIG. 6. Here, in the graph of FIG. 6, the vertical axis represents sulfate ion concentration in terms of $SO_2$ (ppm), and the horizontal axis represents storage term (week), and the result of the sample having the gasket 5 containing 7% sodium sulfite is shown by "high blend", and the result of the sample having the gasket 5 containing 5% sodium sulfite is shown by "standard blend".

As is apparent from FIG. 6, the sulfate ion concentration on the 12th week in the standard blend sample was 3.9 ppm, and the sulfate ion concentration on the 12th week in the high blend sample was 6.8 ppm. In light of the fact that the sulfate ion concentration (in terms of $SO_2$) is requested to be 30 ppm or less by food sanitation standard, it is regarded that sodium sulfite in the present embodiment is unproblematic in the aspect of food sanitation. Sodium sulfite is a food additive like sodium sulfate, and is commonly added, for example, to beer and wine, and also from this point, it is apparent that sodium sulfite added to the gasket 5 is unproblematic in the aspect of food sanitation.

The present invention may be practiced in various alternate ways without being limited to the aforementioned embodiment.

For example, while the outer circumferential face of the bent part 19 is inclined to extend outwardly in the downward direction, and the biasing part 21 biases the bent part 19 downwardly in a closed state in the aforementioned embodiment, the present invention is not limited to such a configuration, and the outer circumferential face of the bent part 19 may be a plane extending in the vertical direction, and the biasing part 21 may push the bent part 19 against the outer circumferential face 3*c* of the container mouth part 3 in a closed state. As shown in FIG. 2, the biasing part 21 has a cusp that contacts the gasket 5.

Sodium sulfite as an oxygen absorber may be contained in the cap main body 4 and the container 2 as well as in the gasket 5.

INDUSTRIAL APPLICABILITY

Since the cap according to the present invention, and a container having the same have high sealing performance, the present invention can be applied to a cap and a container used for accommodating a variety of beverages.

What is claimed is:

1. A cap comprising:

a cap main body having a top wall and a skirt wall extending from an outer circumferential part of the top wall, the skirt wall being provided with an internal thread that comes in screw engagement with an external thread of a container mouth part; and a gasket made of synthetic resin for hermetically sealing the container mouth part, wherein the gasket has a top plate configured to abut a distal end part of the container mouth part to cover a distal end part, and an annular inner leg extending from the top plate, the annular inner leg being adapted to fit closely with an inner circumferential face of the container mouth part, wherein an outer circumferential edge of the top plate is continuously formed with an annular bent part that bends downward with respect to the top plate, the bent part having an inner circumferential face covering an outer circumferential face of the container mouth part, wherein the cap main body has a biasing part that biases an outer circumferential face of the bent part of the gasket in a closed state, so that the biased bent part elastically deforms to be pushed against the outer circumferential face of the container mouth part, wherein the top plate of the gasket includes a flange part disposed between the inner leg and the bent part, and the flange part is thinner than a portion of the top plate that is contiguous with an inner circumferential side of the inner leg, wherein a portion of the gasket connected to the inner circumferential side of the inner leg is positioned lower than the flange part, and wherein a top face of the top plate of the gasket is flush except for a recess part provided in a center thereof.

2. The cap according to claim 1, wherein the outer circumferential face of the bent part of the gasket is inclined downwardly and extends outwardly, and the biasing part of the cap main body is configured to bias the bent part downwardly in the closed state.

3. The cap according to claim 1, wherein a lower end of the bent part is situated between an undulation starting point of a swelling part formed in an outer circumferential face of the inner leg and a maximum diameter part of the swelling part.

4. The cap according to claim 1, wherein the biasing part is a projecting part that projects inside the cap main body provided from a bottom face of the top wall to an inner face of the skirt wall.

5. The cap according to claim 1, wherein the cap main body is made of synthetic resin, a tamper evidence band is connected to a lower part of the skirt wall via breakable bridges, a latch piece extending inwardly and upwardly from a lower part of the tamper evidence band is formed continuously to the tamper evidence band, below the external thread in the container mouth part, a stopper that is overcome by the elastically deformed latch piece upon attachment to the container mouth part, and latched by the elastically recovered latch piece after attachment is provided, the outer circumferential face of the inner leg is formed with a swelling part, and a position in the inner circumferential face of the container mouth part where the swelling part comes into abutment most strongly in the closed state is located 2.0 to 2.5 mm lower than a distal end of the container mouth part.

6. The cap according to claim 1, wherein the gasket contains sodium sulfite.

7. The cap according to claim 1, wherein a thickness of the top wall of the cap main body is 1.0 mm or more.

8. A combination comprising:

a cap including a cap main body and a gasket; and a container including a container mouth part, wherein the cap main body has a top wall and a skirt wall extending from an outer circumferential part of the top wall, the skirt wall being provided with an internal thread that comes in screw engagement with an external thread of the container mouth part, wherein the gasket is made of synthetic resin for hermetically sealing the container mouth part, wherein the gasket has a top plate abutting a distal end part of the container mouth part to cover a distal end part, and an annular inner leg extending from the top plate, the annular inner leg being adapted to fit closely with an inner circumferential face of the container mouth part, wherein an outer circumferential edge of the top plate is continuously formed with an annular bent part that bends downward with respect to the top plate, the bent part having an inner circumferential face covering an outer circumferential face of the container mouth part, wherein the cap main body has a biasing part that biases an outer circumferential face of the bent part of the gasket in a closed state, so that the biased bent part is elastically deformed and is pushed against the outer circumferential face of the container mouth part, wherein the top plate of the gasket includes a flange part disposed between the inner leg and the bent part, and the flange part is thinner than a portion of the top plate that is contiguous with an inner circumferential side of the inner leg, wherein a portion of the gasket connected to the inner circumferential side of the inner leg is positioned lower than the flange part, and wherein a top face of the top plate of the gasket is flush except for a recess part provided in a center thereof.

9. The combination of claim 8, further comprising a beverage accommodated in the container.

10. The combination of claim 9, wherein the container is entirely provided with a gas barrier layer.

11. The combination of claim 8, wherein the container is entirely provided with a gas barrier layer.

12. The combination of claim 8, wherein the biasing part of the cap main body is an annular protruding portion, and the biasing part has a cusp that contacts the gasket.

13. The cap of claim 1, wherein the biasing part of the cap main body is an annular protruding portion, and the biasing part has a cusp that contacts the gasket.

* * * * *